United States Patent [19]

Box

[11] Patent Number: 4,901,876

[45] Date of Patent: Feb. 20, 1990

[54] ALL-PURPOSE UTILITY CRATE

[75] Inventor: Thomas Box, Shrewsbury, N.J.

[73] Assignee: Spectrum International, Inc., Shrewsbury, N.J.

[21] Appl. No.: 190,776

[22] Filed: May 6, 1988

[51] Int. Cl.[4] ..... B65D 25/00

[52] U.S. Cl. ..... 220/22.3; 206/309; 206/387; 206/425; 220/72

[58] Field of Search ..... 220/22.3, 72; 206/309, 206/387, 425

[56] References Cited

U.S. PATENT DOCUMENTS

| | | | |
|---|---|---|---|
| D. 242,600 | 12/1976 | Box . | |
| D. 245,760 | 9/1977 | Box . | |
| D. 258,803 | 4/1981 | Box . | |
| D. 259,294 | 5/1981 | Box . | |
| D. 261,194 | 10/1981 | Box . | |
| D. 265,009 | 6/1982 | Box . | |
| D. 266,709 | 10/1982 | Box . | |
| 2,257,536 | 9/1941 | Roycroft | 220/22.3 X |
| 3,361,293 | 1/1968 | Box . | |
| 3,392,875 | 7/1968 | Bockenstette . | |
| 3,425,594 | 2/1969 | Bridenstine . | |
| 3,568,879 | 3/1971 | Box . | |
| 3,628,684 | 12/1971 | Sere . | |
| 3,655,088 | 4/1972 | Box . | |
| 3,659,743 | 5/1972 | Box . | |
| 3,675,815 | 7/1972 | Rehrig . | |
| 3,682,351 | 8/1972 | De Putter . | |
| 3,997,055 | 12/1976 | Box . | |
| 3,998,327 | 12/1976 | Box . | |
| 3,998,328 | 12/1976 | Box . | |
| 4,190,172 | 2/1980 | Box . | |
| 4,197,958 | 4/1980 | Zeni et al. . | |
| 4,320,845 | 3/1982 | Waller . | |
| 4,411,615 | 4/1984 | Goodrich . | |
| 4,473,156 | 10/1984 | Andersson . | |
| 4,499,997 | 2/1985 | Swingley | 220/22.3 X |
| 4,548,320 | 10/1985 | Box . | |
| 4,796,755 | 1/1989 | Ardenti | 206/387 X |

FOREIGN PATENT DOCUMENTS

| | | |
|---|---|---|
| 2805380 | 2/1979 | Fed. Rep. of Germany . |
| 1515202 | 1/1968 | France . |

*Primary Examiner*—Robert G. Nilson

*Attorney, Agent, or Firm*—Hedman, Gibson, Costigan & Hoare

[57] ABSTRACT

An all purpose crate for transporting and storing a variety of objects. The crate consists of two longitudinal sides, two lateral sides, a bottom surface, an array of attachment holes and a detailed rib structure and is provided with at least one insert divider with pins that insert into the attachment holes which enables the crate to be divided into a series of compartments to accommodate storing a variety of objects including file folders or a combination of records, cassettes and compact discs.

18 Claims, 6 Drawing Sheets

ALL-PURPOSE UTILITY CRATE

FIELD OF THE INVENTION

This invention relates to an all-purpose utility crate for accommodating and storing various sized objects. More specifically, the invention relates to a utility crate that can be used to store a variety of items including file folders and combinations of records, cassettes and compact discs.

BACKGROUND OF THE INVENTION

Crates have been used for many years for the transportation and storage of a variety of objects. At first, crates were made of wood or wood and metal. More recently, crates of plastic have become common and because of the advantageous features of plastic, in many instances, the wooden or wooden and metal crates have been replaced. The plastic crates are typically formed in one integral piece; customarily by injection molding. The usual materials for the crates are polyethylene and polypropylene. The end result is a sturdy, lightweight crate that is durable.

Due to the variety of uses of crates, it has always been a necessary feature for crates to be of strong, sturdy construction to accommodate the weight of the objects transported and stored in the crates.

Plastic crates have been put to use by the public for just about every conceivable storage use probably because of the lightweight, sturdy construction. However, plastic crates are usually a standard rectangular shape and the inside of the crates are not designed to neatly organize, arrange or secure a variety of different sized objects.

SUMMARY OF THE INVENTION

It is an object of the present invention to provide a crate that is durable and lightweight.

It is another object of the present invention to provide a crate that has considerable versatility and can be modified to accommodate a plurality of different sized objects.

It is a further object of the present invention to provide a crate that is uniquely suited for storing a combination of records, cassettes and compact discs.

It is a further object of the present invention to provide a crate that is uniquely suited for storing a plurality of file folders.

These and other objects are obtained hereby by a crate that can be used to transport and store a variety of objects, more specifically, file folders, records, cassettes and compact discs.

The crate is substantially rectangular in shape, with two longitudinal sides, two lateral sides and a bottom portion. The sides and bottom portion of the crate are provided with an array of attachment holes which are used to secure insert dividers in the crate. Insert dividers, which are made of a series of equidistant parallel segments and which are provided with pins that are insertable into the attachment holes, are used to modify the inside configuration of the crate. When placed inside the crates, the insert dividers allow the crates to store a combination of records, cassettes and compact discs.

The crate is also provided with a detailed rib structure, including a series of horizontal, vertical and diagonal ribs running through the longitudinal and lateral sides of the crate. The rib structure helps define a plurality of horizontal and vertical panels found on the longitudinal and lateral sides of the crate as well as providing sound structural support for the crate.

DESCRIPTION OF THE PREFERRED EMBODIMENT

For purposes of this Specification, the term "crate" is used generally and synonymously to mean carton, case or any other container suitable for storage.

Figure 1:
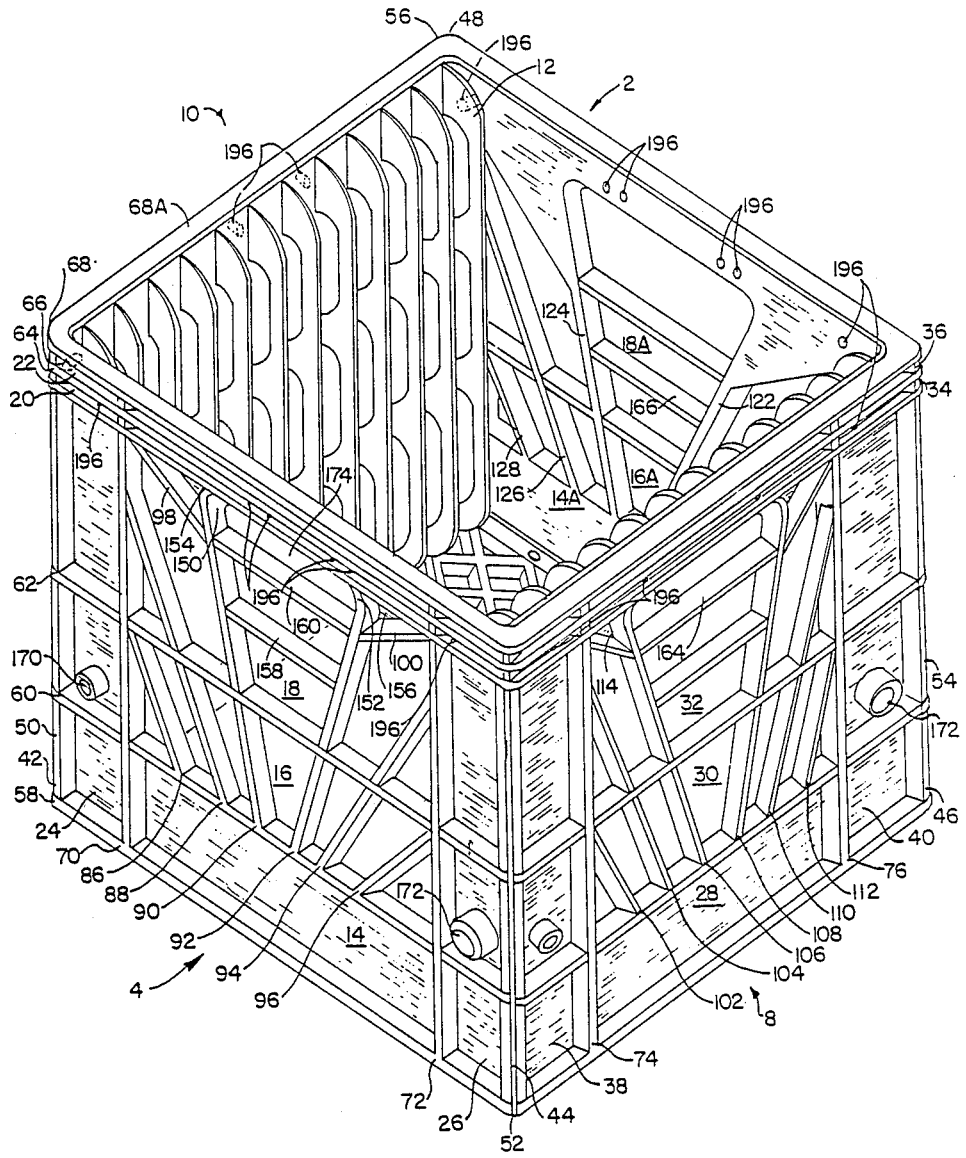
FIG. 1 is an isometric view of the crate of the present invention with insert dividers placed in various positions within the crate.

The present invention is embodied in a substantially rectangular crate (2) shown in perspective in FIG. 1. The crate (2) is provided with two longitudinal sides (4) and (6) and two lateral sides (8) and (10) and insert dividers (12) which can be arranged in a variety of positions within the crate (2) which enables the crate (2) to store a combination of records, cassettes and compact discs.

Each longitudinal side (4) and (6) is similarly configured with a lower solid horizontal panel (14) and (14*a*), two intermediate openings (16), (16*a*), (18) and (18*a*) dominating the sides, and upper solid horizontal panels (20), (20*a*), (22) and (22*a*). Each longitudinal side (4) and (6) has solid vertical end panels (24), (24*a*), (26) and (26*a*) which, with the horizontal panels (14), (14*a*), (20), (20*a*), (22) and (22*a*) define the openings (16), (16*a*), (18) and (18*a*).

Similarly, the lateral sides (8) and (10) are configured essentially the same as the longitudinal sides (4) and (6) with a lower horizontal panel (28) and (28*a*), two intermediate openings (30), (30*a*), (32) and (32*a*), upper solid horizontal panels (34), (34*a*), (36) and (36*a*) and solid vertical end panels (38), (38*a*), (40) and (40*a*) which, with the horizontal panels (28), (28*a*), (34), (34*a*), (36) and (36*a*) define the openings (30), (30*a*), (32) and (32*a*).

The solid vertical end panels (24), (24*a*), (26) and (26*a*) of the longitudinal sides (4) and (6) are integrally formed with the respective solid vertical end panels (38), (38a), (40) and (40a) of the lateral sides (8) and (10) to provide four solid corner members (42), (44), (46) and (48).

Figure 3:
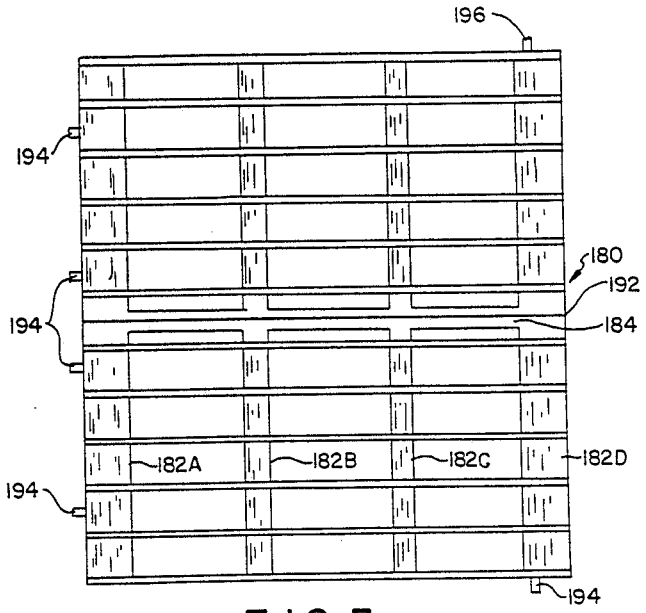
FIG. 3 is a top plan view of the upper portion of an insert divider.
Figure 4:
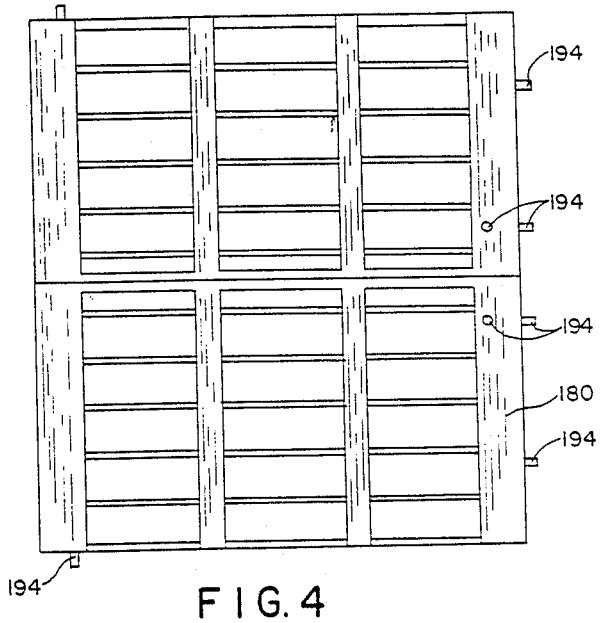
FIG. 4 is a top plan view of the base of the insert divider of FIG. 3.

An array of strategically placed attachment holes (196) are found in the upper horizontal panel (20) and (20a) of the longitudinal sides (4) and (6) and in the upper horizontal panel (34) and (34a) of the lateral sides (8) and (10). At least one attachment hole (196) is found in the solid vertical end panels (24), (24a), (26), (26a) in the upper horizontal rim (20), (20a) of the longitudinal sides (4) and (6) and at least one attachment hole (196) is found in the solid vertical end panels (38), (38a), (40), (40a) in the upper horizontal rim (34), (34a) of the lateral sides (8) and (10). The attachment holes (196) are used to hold one or more insert dividers (12) that are installed within the crate (2) of FIG. 1. An insert divider (12) best seen in FIGS. 3 and 4, is placed within the crate (2) by attaching to one or more of the strategically placed attachment holes (196). The arrangement of attachment holes (196) provide the crate great versatility by allowing the insert dividers (12) to be placed in various positions and at various locations within the crate (2) to accommodate a variety of sizes and types of objects.

The crate (2) is provided with a detailed rib structure or girdle best seen in FIG. 1 to afford durability and strength required for the crate (2). The rib structure is integrally formed with the panel sections of the crate. The rib structure is comprised of four vertical ribs (50), (52), (54) and (56) extending vertically from each corner (42), (44), (46) and (48) of the crate (2), horizontal lower ribs (58) and (60) a horizontal intermediate rib (62) and horizontal upper ribs (64), (66) and (68). The horizontal ribs (58,60,62,64,66 and 68) are continuously formed around the crate (2).

In addition, eight ribs (70), (72), (74), (76), (78), (80), (82) and (84) extend along the respective vertical edges of the openings (16), (16a), (18), (18a), (30) , (30a), (32) and (32a). Illustratively, ribs (70) and (72) are seen in FIG. 1 extending from the bottom horizontal rib (58) along the vertical edge of horizontal panel (14), along the vertical edges of openings (16) and (18), along the vertical edge of horizontal panels (20) and (22) to the horizontal rib (68).

Vertical ribs (74), (76), (78), (80), (82) and (84) are found along the edges of the respective openings (30), (32), (16a), (18a), (30a), and (32a) in the same manner as vertical ribs (70) and (72).

In addition, thirty-two ribs (86), (88), (90), (92), (94), (96), (98), (100), (102), (104), (106), (108), (110), (112), (114), (116), (118), (120), (122), (124), (126), (128), (130), (132), (134), (136), (138), (140), (142), (144), (146) and (148) extend diagonally from the respective vertical edges of the openings (16), (16a), (18), (18a), (30), (30a), (32) and (32a) through said openings in the longitudinal sides (4) and (6) and lateral sides (8) and (10) of the crate (2).

Illustratively, rib (86) is seen extending from the corner formed by horizontal rib (62) and the vertical rib (70), through opening (16) at about a 35° angle to the vertical rib (70) to a point along horizontal rib (60).

Rib (96) is seen extending from the corner formed by horizontal rib (62) and vertical rib (72) through opening (16) at about a 35° angle to vertical rib (72) to a point along horizontal rib (60).

Rib (88) is seen extending from a point along vertical rib (70) in opening (18), through opening (18) at about a 30° angle to vertical rib (70), continuing through opening (16) to a point along horizontal rib (60).

Rib (94) is seen extending from a point along vertical rib (72), in opening (18), through opening (18) at about a 30° angle to vertical rib (72), continuing through opening (16) to a point along horizontal rib (60).

Rib (90) is seen extending from a point along horizontal rim (64) through opening (18) at about a 70° angle to horizontal rib (64) to horizontal rim (62), continuing from horizontal rim (62) through opening (16) at about a 70° angle to horizontal rib (60). Rib (90) is provided with an upper radius section (150) to follow the edge of opening (18).

Rib (92) is seen extending from a point along horizontal rim (64) through opening (18) at about a 70° angle to horizontal rib (64) to horizontal rib (62), continuing from horizontal rim (62) through opening (16) at about a 70° angle to horizontal rib (60). Rib (92) is provided with an upper radius section (152) to follow the edge of opening (18).

Rib (98) is seen extending from the corner formed by upper horizontal rib (64) and vertical rib (70) through opening (18) at about a 60° angle to vertical rib (70) to a point along rib (90) forming a closed panel section (154).

Rib (100) is seen extending from the corner formed by horizontal rib (64) and vertical rib (72) through opening (18) at about a 60° angle to vertical rib (72) to a point along rib (92) forming a closed panel section (156).

In addition, each upper opening (18), (18a), (32) and (32a) has two substantially parallel horizontal ribs, (158), (160), (162), (164), (166), (168), (170) and (172). Illustratively, horizontal ribs (158) and (160) extend horizontally from a point along rib (90) in opening (18) to a point along rib (92). Ribs (158) and (160) along with ribs (90) and (92) form the handle (174).

Diagonal ribs (102), (104), (106), (108), (110), (112), (114), (116), (118), (120), (122), (124), (126), (128), (130), (132), (134), (136), (138), (140), (142), (144), (146) and (148) are found along the respective vertical edges of each of the sides (6), (8) and (10) in the same manner as diagonal ribs (86), (88), (90), (92), (94), (96), (98) and (100) of longitudinal side (4).

The solid vertical end panels (24), (38), (26a) and (40a) are provided with a peg (170) and the solid vertical end panels (24a), (26), (38a) and (40) are provided with a substantially round receptacle (172) capable of receiving the peg (170). The fitting of pegs (170) into receptacles (172) enables one crate to be securely stacked on top of another crate.

The top (68a) of the crate (2), as best seen in FIG. 1, is the flat surface of the upper continuous rib (68).

Figure 2:
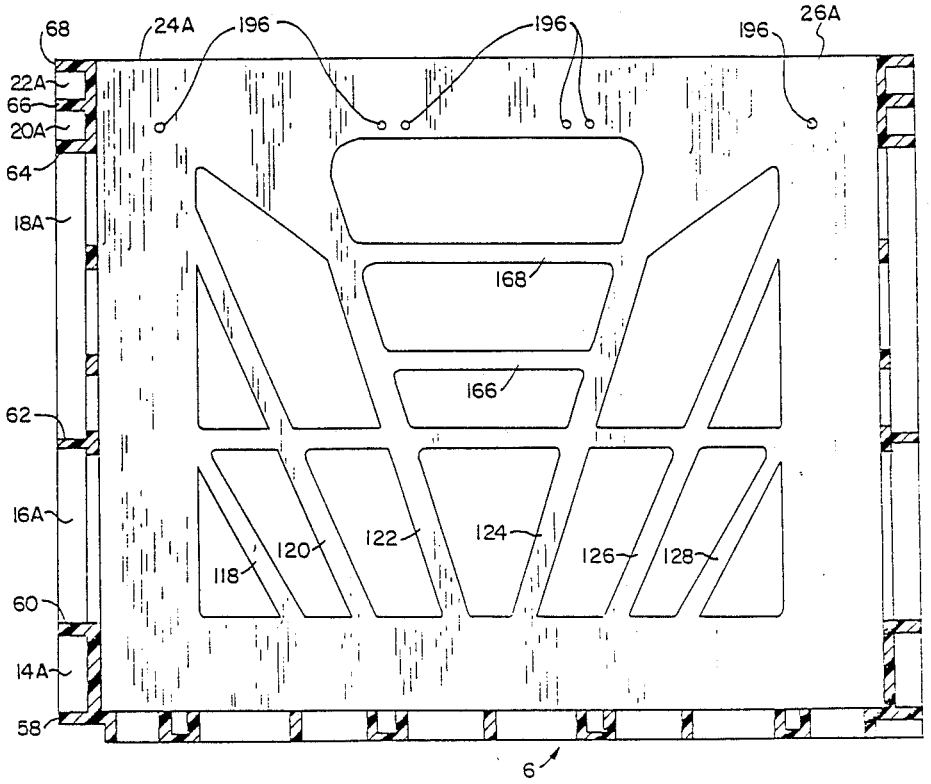
FIG. 2 is a side elevational view of the inner side of a longitudinal side of the crate of FIG. 1.

FIG. 2 is a view of the longitudinal side (6) taken from the inside of the crate (2) shown in FIG. 1 which provides a good perspective of the attachment holes (196) found in the upper portion (20a) of the longitudinal side (6).

Figure 9:
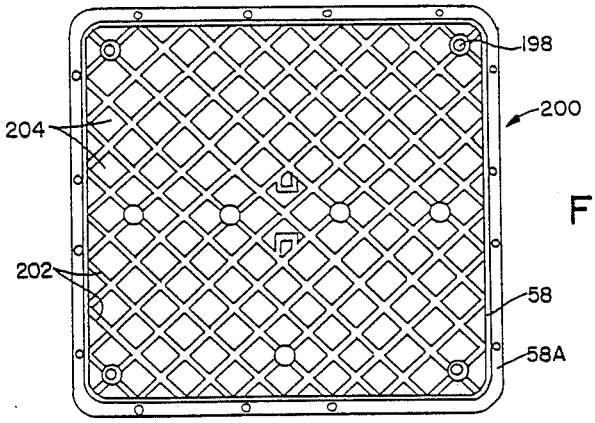
FIG. 9 is a plan view of the crate taken from the bottom.

The bottom (200) of the crate (2) as best seen in FIG. 9, is essentially the lower surface of the continuous bottom horizontal rib (58) with a rim (58a) depending downwardly from the inner edge of rib (58).

The bottom (200) of the crate (2) is formed in a mesh-like configuration with diagonally extending members (202) defining openings (204). Attachment holes (198) are also found at strategic locations along the bottom (200) of the crate (2) and are designed and sized to accommodate the insert divider (12) in a variety of positions.

Figure 5:
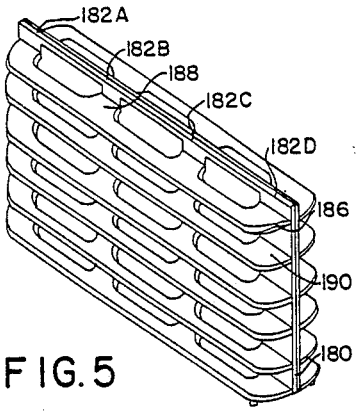
FIG. 5 is a perspective view of the insert divider of FIG. 3 which has been folded in half.
Figure 7:
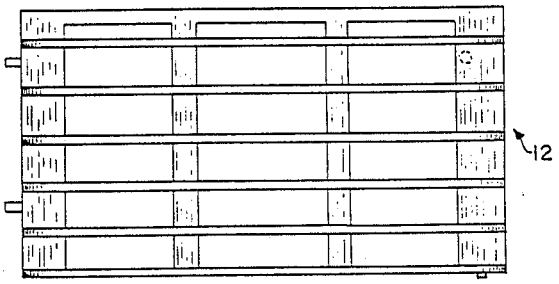
FIG. 7 is a top plan view of the upper portion of the insert divider of FIG. 3 that has been divided in half.
Figure 8:
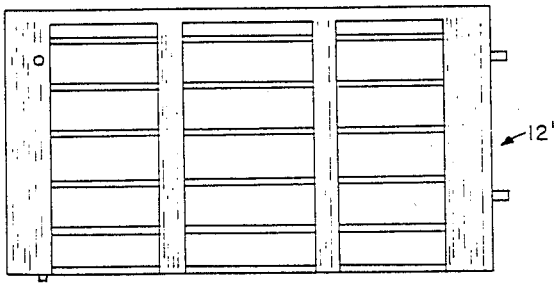
FIG. 8 is a top plan view of the lower portion of the insert divider of FIG. 7.

The insert divider (12), as best seen in FIGS. 3 and 4, is substantially rectangular in shape having a base (180) comprised of substantially linear and parallel strips (182*a*), (182*b*), (182*c*) and (182*d*) with a centrally disposed perpendicular dividing strip (184) running through the parallel strips (182*a*), (182*b*), (182*c*) and (182*d*). The outer strips (182*a*) and (182*d*) are larger in width than the inner parallel strips (182*b*) and (182*c*) for strength and durability purposes. The dividing strip (184) has a centrally disposed score line or groove (192) for optionally folding the insert divider (12) in half as seen in FIG. 5 or for breaking the insert divider (12) into two separate pieces (12) and (12') as seen in FIGS. 7 and 8.

Figure 6:
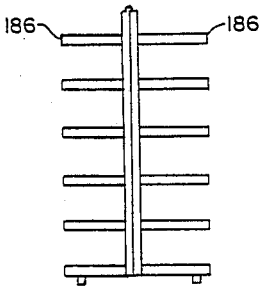
FIG. 6 is a side elevational view of the folded insert divider of FIG. 5.

The insert divider (12) is also provided with a plurality of substantially parallel segments (186) extending upwardly from the base (180). Each segment (186) is substantially equidistant from the adjacent segments (186). Each segment (186), as best seen in FIG. 5, has an elongated arch shape with tabs (188) depending downwardly from the upper portion (190) of the segment onto the parallel strips (182) that comprise the base (180). FIG. 6 is a side elevational view of the folded insert divider (12) of FIG. 5. The folding of said insert divider (12) along the score line (192) causes the segments (186) to protrude in opposing directions.

The insert divider (12) as seen in FIGS. 3 and 4, is further provided with strategically placed pins (194) which are found at various positions along the outer parallel strips (182*a*) and (182*d*) or along the outer segments (186).

The pins (194) provide the means for installing the insert divider (12) in the crate (2). The pins (194) are placed along the insert divider (12) in a manner which will enable the pins (194) to fit into attachment holes (196) and (198) which are found at strategic locations within the crate (2) allowing the insert divider (12) to divide the crate (2) into a plurality of sections of varying sizes. The attachment holes (198) of the bottom (200) of the crate (2) are sized to accommodate up to two pins (194) of an insert divider (12).

Figure 10:
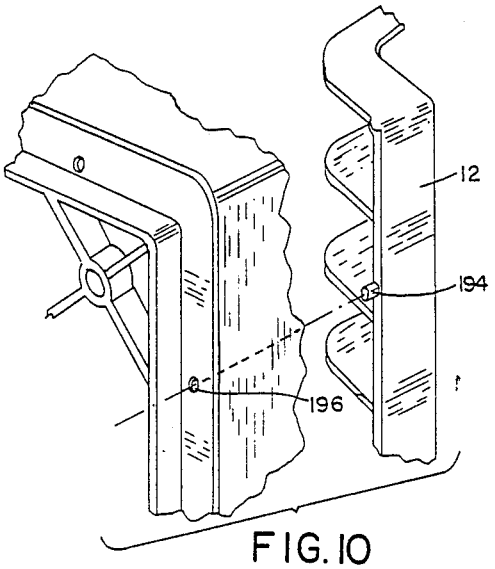
FIG. 10 is a partial exploded perspective view of a crate and an insert divider with a pin of the divider being aligned with an attachment hole in the crate.
Figure 11:
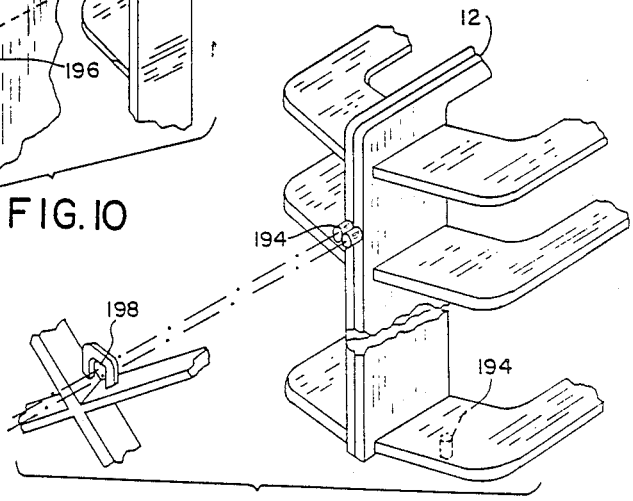
FIG. 11 is a partial exploded perspective view of a folded insert divider with two pins aligned with an attachment hole adapted for two pins.

FIG. 10 shows the pin (194) of an insert divider (12) aligned with an attachment hole (196) found in the crate (2) FIG. 11 shows an insert divider (12) that has been folded in half along the score line (192) with two pins (194) about to be inserted into an attachment hole (198) found at the bottom (200) of the crate (2).

Figure 12:
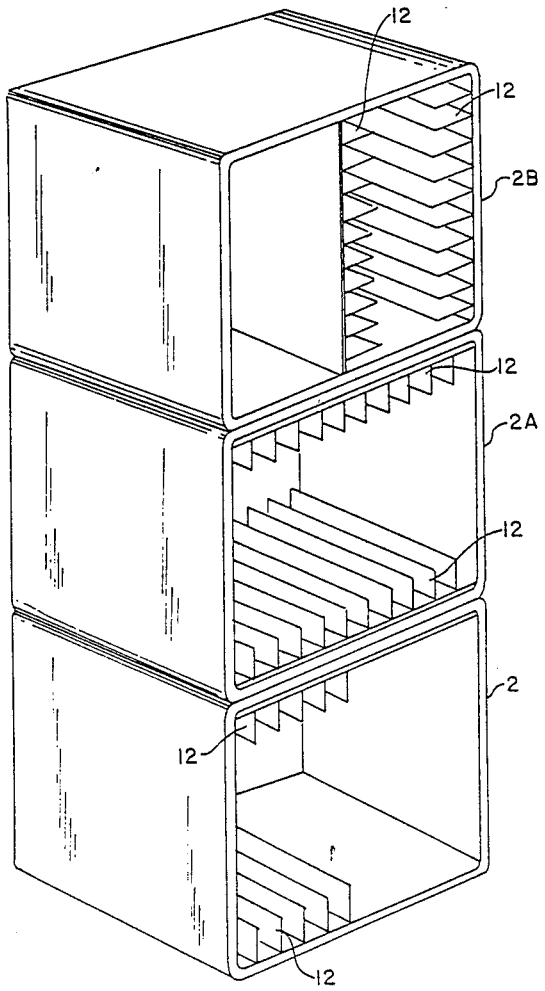
FIG. 12 is a perspective view of three stacked crates with each crate depicting a variety of arrangements of insert dividers.

FIG. 12 depicts three crates (2), (2*a*) and (2*b*) in a stacked formation. The peg (170) of one crate (2) (not shown) will fit into the receptacle (172) of a second crate (2'). Insert dividers (12) of the present invention have been placed within each crate (2), (2*a*) and (2*b*) to illustrate the various positions in which an insert divider (12) can be arranged within a crate (2), (2*a*) and (2*b*).

In a specific embodiment of the crate (2) shown in FIG. 1 and configured to accommodate file folders and records, cassettes or compact discs or a combination thereof, the longitudinal sides (4) and (6) are 14" in length and the lateral sides (8) and (10) are 13" in length. The overall height of the crate is 11". The array of attachment holes (196) are located ¾" from the top (68*a*) of the crate (2). Six attachment holes (196) are found in the longitudinal sides (4) and (6) and four attachment holes (196) are found in the lateral sides (8) and (10). In longitudinal side (4), the six attachment holes (196) are located 1.5", 5.25", 5.75", 8", 8.5" and 12.5" from the vertical rib (50) respectively. Similarly, the six attachment holes in longitudinal side (6) are located 1.5", 5.25", 5.75", 8", 8.5" and 12.5" from the vertical rib (54). In lateral side (8), the four attachment holes (196) are located 1.5", 5.25", 7.5" and 11.375" from the vertical rib (52) respectively. Similarly, the four attachment holes in lateral side (10) are located 1.5", 5.25", 7.5" and 11.375" from vertical ribs (56). The bottom (200) of the crate (2) is formed with 8 attachment holes (198). The outer four attachment holes (198) are located 2.25" from the continuous bottom horizontal rib (58) and four attachment holes (198) are located 5.5" from continuous bottom horizontal rib (58). The insert divider (12) is 12" in length and 10.5" in width. The preferred height of the segments (186) is 1.5" in height. The placement of the pins (194) on the insert divider (12) is important to enable the insert divider (12) to fit in the attachment holes (196) and (198). It is also important that the insert divider (12) is sized in order to fit within the crate (2). The insert divider (12) has 4 pins (194) along the outer parallel strip (182*a*), 2 pins (194) along the second parallel strip (182*d*) and 2 pins (194) along the outer segments (186). Two of the pins (194) on the outer parallel strip (182*a*) and the two pins (194) on parallel segment (182*d*) are located on opposing sides of the score line (192), 1⅛" away from said score line (192). The remaining two pins (194) on outer parallel strip (182*a*) are located on opposing sides of the score line (192), 4½" from the score line (192).

The two pins (194) found on the outer segments (186) are 1 1/16" from the base (180) of the insert divider (12).

I claim:

1. A crate for storing file folders and combinations of records, cassettes or compact discs, comprising:

two longitudinal sides, two lateral sides, a bottom, an array of attachment holes strategically located in the longitudinal sides, lateral sides and bottom, an insert divider for partitioning the crate into a plurality of storage areas, said insert divider comprised of a base having a plurality of substantially linear and parallel strips, a centrally disposed dividing strip running perpendicular to the parallel strips, a plurality of substantially parallel segments along the upper portion, and a series of pins along the outer most parallel strips or along the outer segments for insertion into the attachment holes in the crate to attach the insert divider to the crate, and a rib structure surrounding the longitudinal and vertical sides.

2. A crate according to claim 1 wherein the two longitudinal sides and two lateral sides each have a lower solid horizontal panel, upper solid horizontal panels, solid vertical end panels, and openings defined by the solid horizontal panels and solid vertical end panels.

3. A crate according to claim 2 wherein the rib structure is comprised of vertical ribs extending from the corner of the crate formed by the solid vertical end panels, and continuous horizontal ribs surrounding the lower, intermediate and upper panels.

4. A crate according to claim 3 wherein the continuous horizontal ribs are comprised of two horizontal lower ribs, one of said ribs being located at the bottom of the crate, a horizontal intermediate rib and three horizontal upper ribs, one of said ribs being located at the top of the crate.

5. A crate according to claim 3 wherein the rib structure is comprised of ribs which extend along the openings in the longitudinal and lateral sides forming vertical edges for the openings.

6. A crate according to claim 3 wherein the rib structure is comprised of a plurality of ribs which extend diagonally through the openings from the vertical edges of the openings in the longitudinal and lateral sides.

7. A crate according to claim 3 wherein the rib structure is comprised of substantially horizontal ribs in the upper opening of the longitudinal and lateral sides and wherein the upper horizontal rib defines a handle.

8. A crate according to claim 3 wherein the attachment holes in the longitudinal sides are located 1.5", 5.25", 5.75", 8", 8.5" and 12.5" from a vertical rib which extends from the corner of the crate and the attachment holes in the lateral sides are located 1.5", 5.25", 5.75" and 11.375" from a vertical rib which extends from the corner of the crate.

9. A crate according to claim 1 further comprising a bottom surface formed in a mesh pattern that defines a plurality of openings.

10. A crate according to claim 9 wherein the bottom surface of the crate is further comprised of a plurality of larger sized attachment holes.

11. A crate according to claim 1 wherein the segments are an elongated arch shape and have tabs depending downwardly from the upper portion of the segment onto the parallel strips, said segments being equidistant from each other along the parallel strips.

12. A crate according to claim 1 wherein the dividing strip is further comprised of a score line at its center.

13. A crate according to claim 12 where four of the pins on the insert divider are located 1⅛" from the score line, two of the pins are located 4¼" from the score line and the two pins are located on the segments 1 1/16" from the base.

14. A crate according to claim 1 wherein the material for the crate is polyethylene.

15. A crate according to claim 1 wherein the material for the crate is polypropylene.

16. A crate according to claim 1 wherein the length of the longitudinal sides is 14" and the length of lateral sides is 13", the height of the crate is 11".

17. A crate according to claim 1 wherein the insert divider is 12" long and 10.5" in width.

18. A crate according to claim 1 wherein the solid vertical end panels are provided with a peg or a receptacle capable of receiving said peg which enables the crate to be stacked with other crates.

* * * * *